US007479629B2

(12) United States Patent
Overney et al.

(10) Patent No.: US 7,479,629 B2
(45) Date of Patent: Jan. 20, 2009

(54) MULTICHANNEL RAPID SAMPLING OF CHROMATOGRAPHIC PEAKS BY TANDEM MASS SPECTROMETER

(75) Inventors: Gregor Overney, San Jose, CA (US); William Frazer, Mountain View, CA (US); Harry Bunting, San Jose, CA (US); Chiachen Chang, Santa Clara, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 321 days.

(21) Appl. No.: 11/467,118

(22) Filed: Aug. 24, 2006

(65) Prior Publication Data

US 2008/0073496 A1 Mar. 27, 2008

(51) Int. Cl.
*H01J 49/02* (2006.01)

(52) U.S. Cl. ..... 250/282; 250/281; 250/287; 250/290; 250/293

(58) Field of Classification Search ..... 250/281, 250/282, 287, 290, 293
See application file for complete search history.

(56) References Cited

U.S. PATENT DOCUMENTS

| | | | | |
|---|---|---|---|---|
| 6,717,130 | B2 * | 4/2004 | Bateman et al. | 250/282 |
| 6,982,414 | B2 * | 1/2006 | Bateman et al. | 250/282 |
| 7,112,784 | B2 * | 9/2006 | Bateman et al. | 250/282 |
| 2002/0063206 | A1 * | 5/2002 | Bateman et al. | 250/281 |
| 2004/0031916 | A1 * | 2/2004 | Bateman et al. | 250/281 |
| 2004/0041090 | A1 * | 3/2004 | Bloomfield et al. | 250/282 |
| 2004/0041091 | A1 * | 3/2004 | Bateman et al. | 250/282 |
| 2005/0263693 | A1 * | 12/2005 | Vachet et al. | 250/282 |
| 2005/0277789 | A1 * | 12/2005 | Bloomfield et al. | 564/4 |
| 2006/0138320 | A1 * | 6/2006 | Bateman | 250/288 |

FOREIGN PATENT DOCUMENTS

| | | |
|---|---|---|
| GB | 2421839 | 7/2006 |
| GB | 2439814 | 1/2008 |
| WO | 03094197 | 11/2003 |

OTHER PUBLICATIONS

UK Search Report, Dated Jun. 2, 2008, 1 page, in Application No. GB0716171.4, which corresponds to the present application.

* cited by examiner

*Primary Examiner*—Jack I Berman
*Assistant Examiner*—Michael Maskell

(57) ABSTRACT

Systems and methods for optimizing the analysis of co-eluting compounds during a cycle of a tandem mass spectrometer system are provided. The tandem mass spectrometer system switches fast from analyzing one compound ion to analyzing another compound ion and from one collision cell energy to another. The fast switching allows complex sampling patterns that improve coverage of the ionic signal of the co-eluting compounds while allowing different collision cell energies to be analyzed.

32 Claims, 10 Drawing Sheets

200

| Sub-cycle Number | # of Transients | Compound Ion |
|---|---|---|
| 201 | 10,000 | A |
| 202 | 10,000 | B |
| 203 | 10,000 | C |

FIG. 2

300

| Sub-cycle Number | # of Transients | Compund Ion |
|---|---|---|
| 301 | 5,000 | A |
| 302 | 5,000 | B |
| 303 | 5,000 | C |
| 304 | 5,000 | A |
| 305 | 5,000 | B |
| 306 | 5,000 | C |

FIG. 3

500

| Sub-cycle Number | # of Transients | Compund Ion | Fixed Collision Energy |
|---|---|---|---|
| 501 | 1,000 | A | $CE_1(A)$ |
| 502 | 1,000 | B | $CE_1(B)$ |
| 503 | 1,000 | C | $CE_1(C)$ |
| 511 | 1,000 | A | $CE_2(A)$ |
| 512 | 1,000 | B | $CE_2(B)$ |
| 513 | 1,000 | C | $CE_2(C)$ |
| ⋮ | ⋮ | ⋮ | ⋮ |
| 591 | 1,000 | A | $CE_{10}(A)$ |
| 592 | 1,000 | B | $CE_{10}(B)$ |
| 593 | 1,000 | C | $CE_{10}(C)$ |

FIG. 5

600

| Sub-cycle Number | # of Transients | Compund Ion | Fixed Collision Energy |
|---|---|---|---|
| 601 | 500 | A | $CE_1(A)$ |
| 602 | 2,000 | B | $CE_1(B)$ |
| 603 | 500 | C | $CE_1(C)$ |
| 611 | 500 | A | $CE_2(A)$ |
| 612 | 2,000 | B | $CE_2(B)$ |
| 613 | 500 | C | $CE_2(C)$ |
| ⋮ | ⋮ | ⋮ | ⋮ |
| 691 | 500 | A | $CE_{10}(A)$ |
| 692 | 2,000 | B | $CE_{10}(B)$ |
| 692 | 500 | C | $CE_{10}(C)$ |

FIG. 6

700

| Sub-cycle Number | # of Transients | Compund Ion | Fixed Collision Energy |
|---|---|---|---|
| 701 | 500 | A | $CE_1(A)$ |
| 702 | 2,000 | B | $CE_1(B)$ |
| 703 | 500 | C | $CE_1(C)$ |
| 711 | 2,000 | A | $CE_2(A)$ |
| 712 | 500 | B | $CE_2(B)$ |
| 713 | 500 | C | $CE_2(C)$ |
| ⋮ | ⋮ | ⋮ | ⋮ |
| 791 | 500 | A | $CE_{10}(A)$ |
| 792 | 500 | B | $CE_{10}(B)$ |
| 793 | 2,000 | C | $CE_{10}(C)$ |

FIG. 7

800

| Sub-cycle Number | # of Transients | Compund Ion | Fixed Collision Energy |
|---|---|---|---|
| 801 | 1,000 | A | $CE_1(A)$ |
| 802 | 1,000 | B | $CE_1(B)$ |
| 803 | 1,000 | C | $CE_1(C)$ |
| 811 | 1,000 | A | $CE_2(A)$ |
| 812 | 1,000 | B | $CE_1(B)$ |
| 813 | 1,000 | C | $CE_1(C)$ |
| ⋮ | ⋮ | ⋮ | ⋮ |
| 891 | 1,000 | A | $CE_{10}(A)$ |
| 892 | 1,000 | B | $CE_5(B)$ |
| 893 | 1,000 | C | $CE_2(C)$ |

FIG. 8

900

| Sub-cycle Number | # of Transients | Compund Ion | Fixed Collision Energy |
|---|---|---|---|
| 901 | 1,000 | A | $CE_1(A)$ |
| 902 | 1,000 | B | $CE_1(B)$ |
| 903 | 1,000 | C | $CE_1(C)$ |
| 911 | 1,000 | C | $CE_2(C)$ |
| 912 | 1,000 | A | $CE_2(A)$ |
| 913 | 1,000 | B | $CE_2(B)$ |
| 921 | 1,000 | C | $CE_3(C)$ |
| 922 | 1,000 | A | $CE_3(A)$ |
| 923 | 1,000 | B | $CE_3(B)$ |
| 931 | 1,000 | C | $CE_4(C)$ |
| 932 | 1,000 | C | $CE_5(C)$ |
| 933 | 1,000 | A | $CE_4(A)$ |

FIG. 9

MULTICHANNEL RAPID SAMPLING OF CHROMATOGRAPHIC PEAKS BY TANDEM MASS SPECTROMETER

BACKGROUND OF THE INVENTION

The present invention relates generally to mass spectrometry and more particularly to systems and methods for improving the analysis of chromatographic peaks using a tandem mass spectrometer.

Mass spectrometry (MS) is an analytical technique used to measure the mass-to-charge ratio (m/z) of ions. A mass spectrometer is a device used for mass spectrometry, and produces a mass spectrum of a sample to find its composition. This is normally achieved by ionizing the sample and separating ions of differing masses and recording their relative abundance by measuring intensities of ion flux. A typical mass spectrometer comprises three parts: an ion source, a mass analyzer, and a detector.

Tandem mass spectrometry involves two or more stages of mass selection or analysis, usually separated by a stage of fragmentation. A tandem mass spectrometer is capable of multiple rounds of mass spectrometry. For example, in a first stage, one mass analyzer can isolate one precursor compound ion from many entering a mass spectrometer. The compound ions can then be fragmented in a second stage which may include a collision cell. Compound ions are typically confined to the collision cell, stabilized via a multipole, and fragmented via collision-induced dissociation (CID) with inert gas molecules. A second mass analyzer then separates the fragment ions produced from the compound ions, and the fragment ions are detected using a detection system. The result is a mass spectrum of the fragment ions for each compound ion.

The compound ions may be introduced into the first mass analyzer concurrently and over a limited time frame, such as across a liquid chromatographic (LC) peak. During LC/MS analysis of complex samples, e.g. the trypsin-digested protein content of human serum, hundreds to thousands of compounds may be present. Even when operating with separation regimes delivering high peak capacity, at any particular point in time, multiple compounds are typically eluted in parallel. Thus, multiple co-eluting compounds must be analyzed within the same time window, which can make obtaining sufficient and accurate data difficult.

Also, chromatographic peaks may be narrow. For example, Agilent's new HPLC-Chip increases chromatographic resolution by creating narrow chromatographic peaks (usually 2-3 seconds wide). The narrow peaks give less time to sample the compound ions, but give a greater abundance of the compound ions. The combination of multiple co-eluting compounds and narrow chromatographic peaks requires a fast sampling rate for MS/MS analysis to be successfully applied. For instance, to perform an MS/MS analysis (one cycle) of co-eluting compounds A, B and C over a three second elution window, on average only one second can be used to analyze each of the corresponding compound ions.

The analysis of each co-eluting compound could occur during a one second sub-cycle, giving three sub-cycles. However, one may not know exactly where in the chromatographic peak (elution window) that a specific co-eluting compound, e.g. A, is concentrated. Thus, an insufficient amount of compound ion A could be measured if A is concentrated at the end of the elution window and its analysis sub-cycle occurs at the beginning of the elution window.

To improve coverage, typically a first mass analyzer cyclically measures each of the three ions multiple times across the elution window. In this manner, the likelihood of measuring compound A is increased. A lack of fast switching often contributes to poor statistical coverage of an elution window due to relatively long and contiguous blocks of time that a compound ion is not measured.

Also, during a sub-cycle for a specific ion, the collision energy may be varied over a range. This is typically done, for example, because the ideal collision energy may not be known. Systems and methods have been hampered in not being able to provide accurate measurements at different collision energies of different compound ions across the same elution time window.

Therefore it is desirable to provide systems and methods that overcome the above and other problems.

BRIEF SUMMARY OF THE INVENTION

The present invention provides systems and methods of analyzing compound ions resulting from co-eluting precursor compounds. Analysis occurs during a cycle of a tandem mass spectrometer system having a collision cell. Aspects of the present invention allow for collecting data for all ions of interest using different collision energies, but without having to vary the collision energy while an ion is being investigated. According to one aspect, the tandem mass spectrometer system switches quickly from analyzing one compound ion to analyzing another compound ion and from one collision cell energy to another. The fast switching allows complex sampling patterns. In one aspect, different sets of analysis sub-cycles utilize different collision cell energies and different sub-cycles within a set analyze different compound ions. Thus, improved coverage of the ionic signal of the co-eluting compounds is obtained, and different collision cell energies are used for analysis.

According to one embodiment of the present invention, a computer-implemented method is provided for analyzing compound ions resulting from co-eluting precursor compounds. The method typically includes analyzing the compound ions during a plurality of sets of analysis sub-cycles. Each of the compound ions may be analyzed during a set of sub-cycles, and each sub cycle of a set may analyze a different compound ion. The sub-cycles of a set occur consecutively in time, and each sub-cycle uses a fixed collision cell energy (which may or may not be different from the collision cell energy used in other sub-cycles). The method also typically has one sub-cycle that analyzes a first compound ion using a first collision cell energy, and another sub-cycle of a different set that also analyzes the first compound ion, but uses a second and different collision cell energy.

In one aspect, the compound ions are analyzed in different orders for different sets. The number of compound ions may equal the number of co-eluting precursor compounds, and the number of sub-cycles in a set may equal the number of compound ions. In other aspects, the collision cell energies of the sub-cycles of a set differ, and the collision energies of sub-cycles that analyze the same compound differ. In one embodiment, the collision cell energies of the sub-cycles that analyze the same compound ion successively increase or decrease for each set. In another embodiment, some or all of the sub-cycles that analyze the same compound use different collision cell energies. Also, the duration of the sub-cycles may differ.

In one embodiment, the method also includes determining the number of co-eluting precursor compounds that are of interest; determining an appropriate number of collision energies for each co-eluting precursor compound of interest; and setting the compound ions to be analyzed for each sub-cycle of each set, and the number of transients and collision energy of each sub-cycle. In another embodiment, the tandem mass spectrometer system is a quadrupole time-of-flight spectrometer. In one aspect, a duration of each sub-cycle is determined by a specified number of transients. The number of transients for each sub-cycle may be the same or it may vary, and the total number of transients during a cycle may be the same for each compound ion.

According to another embodiment of the present invention, a tandem mass spectrometer system is provided for analyzing compound ions resulting from co-eluting precursor compounds. The tandem mass spectrometer system includes a control system and a tandem mass spectrometer having a first mass analyzer, a collision cell, and a second mass analyzer. The control system includes logic for determining parameters for a cycle. The parameters include a number of sets of analysis sub-cycles, a number of sub-cycles for each set, a compound ion to be analyzed for each sub-cycle, a number of transients for each sub-cycle, and/or the collision cell energy for each sub-cycle. The control system also includes logic for providing control signals to the tandem mass spectrometer based on the parameters, where the signals control the analysis of the compound ions. The parameters may describe complex sampling patterns as described herein.

The control system logic may be embedded within the mass spectrometer, or may exist outside of the mass spectrometer, e.g., in a stand-alone computer system or other system or device including processing capabilities. In other aspects, the logic includes a digital signal processor, and/or the logic includes a processor executing an operating system. The logic may be part of a single integrated circuit or multiple circuits.

In one embodiment, the control system further includes a memory device having a memory slot for each compound ion that is analyzed during a cycle. The slot holds mass spectrum data for a particular compound ion. In one aspect, the control system also includes a data acquisition circuit, wherein data is transferred after each sub-cycle from the data acquisition circuit to the memory slot allocated for the compound ion analyzed during that sub-cycle. In another embodiment, the second mass analyzer includes a time-of-flight analyzer. In one aspect, the first mass analyzer is capable of being switched from analyzing one compound ion to another compound ion within about 10 milliseconds or less.

Reference to the remaining portions of the specification, including the drawings and claims, will realize other features and advantages of the present invention. Further features and advantages of the present invention, as well as the structure and operation of various embodiments of the present invention, are described in detail below with respect to the accompanying drawings. In the drawings, like reference numbers indicate identical or functionally similar elements.

BRIEF DESCRIPTION OF THE DRAWINGS

FIG. 2 illustrates a MS/MS cycle for analyzing three co-eluting compounds (A, B, and C).

FIG. 3 illustrates another MS/MS cycle for analyzing three co-eluting compounds (A, B, and C).

FIG. 5 illustrates a MS/MS cycle having sets of sub-cycles whose fixed collision energies differ according to an embodiment of the present invention.

FIG. 6 illustrates a MS/MS cycle having sets of sub-cycles whose fixed collision energies differ and number of transients of sub-cycles within a set differ according to an embodiment of the present invention.

FIG. 7 illustrates a MS/MS cycle having sets of sub-cycles whose fixed collision energies differ and number of transients for sub-cycles analyzing a specific compound ion differ from set to set according to an embodiment of the present invention.

FIG. 8 illustrates a MS/MS cycle having sets of sub-cycles, some of which have fixed collision energies that differ according to an embodiment of the present invention.

FIG. 9 illustrates a MS/MS cycle having sets of sub-cycles whose fixed collision energies differ and in which the order of analysis of the compound ions within the sets differ according to an embodiment of the present invention.

DETAILED DESCRIPTION OF THE INVENTION

The present invention provides systems and methods for optimizing the analysis of co-eluting precursor compounds during an analysis cycle of a tandem mass spectrometer system. For example, the present invention provides in different aspects: very fast switching between different MS/MS analyses (precursor ions) during a cycle; complex sampling patterns over a chromatographic peak using the fast switching capabilities; and collecting data for all compound ions of interest at different collision energies, but without having to vary the collision energy while a compound ion is investigated. One skilled in the art will appreciate that embodiments of the invention may be applied to different types of tandem spectrometers.

Figure 1:
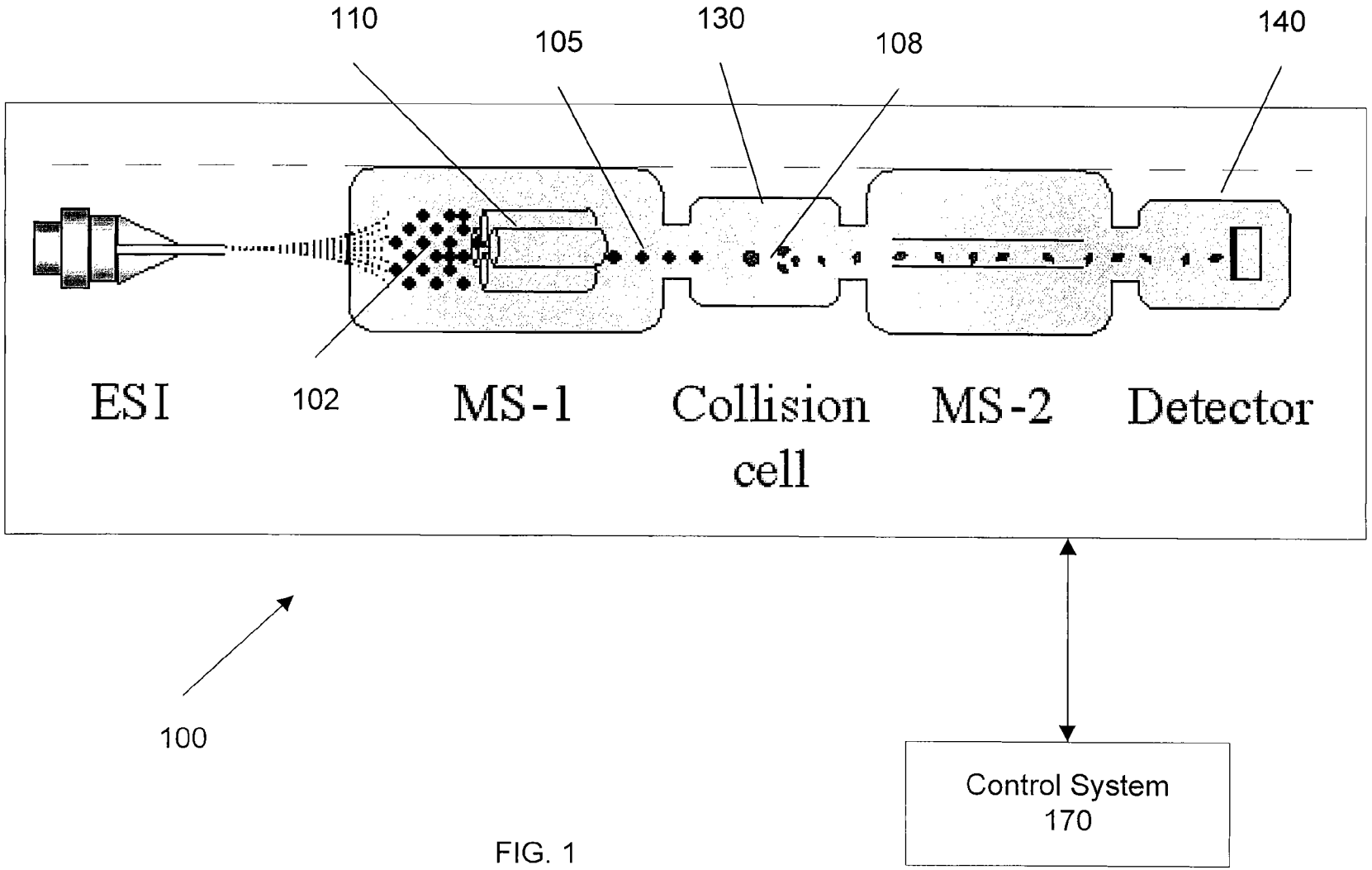
FIG. 1 illustrates a tandem mass spectrometer system according to an embodiment of the present invention.

FIG. 1 shows a tandem mass spectrometer system 100 including or coupled with a control system 170 according to an embodiment of the invention. The compound (precursor) ions 102 are provided for analysis, e.g., inserted by an electrospray ionization (ESI) nozzle or other ion insertion device. During any one time, focusing element 110 of mass analyzer MS-1 is configured to filter out ions of a specific mass, such as compound ions 105, allowing filtered compound ions 105 to enter a fragmentation region such as collision cell 130.

In one embodiment, collision cell 130 operates by sending compound ions 105 through a region containing a background gas, typically an inert gas, which causes compound ions 105 to fragment into smaller (fragment) ions 108, a process known in the art as collision-induced dissociation (CID). Other embodiments can use other collision cell types such as photoionization, surface ionization or electron impact. Collision cell 130 may have an energy setting that corresponds to the kinetic energy of compound ion 105. The kinetic energy may be controlled by varying a voltage, a pressure gradient, or other suitable environmental settings. A collision cell energy may also be varied by the pressure of the background gas.

Collision cell 130 may also focus the fragment ions 108 into the second mass analyzer MS-2. MS-2 is configured to filter out the fragment ions of interest, so that they may be detected by a detector 140. When mass analyzer MS-1 begins to analyze a new compound ion, the MS-1 setting is changed, for example a change to the mass-to-charge ratio (m/z) of the new compound ion to be filtered. The order of the compound ions measured is termed a sampling pattern. Herein, a compound ion may also be referred to as a precursor ion.

In one embodiment, MS-2 includes a time-of-flight (TOF) analyzer. MS-2 may alternatively include a magnetic sector device, quadrupole mass filter or other such means for obtaining a mass spectrum such that the operation is fast enough to allow sufficiently rapid sampling. In a tandem mass spectrometer, MS-1 and the collision cell typically includes one or more quadrupoles (such as in a QqTOF), but any other multipole or other suitable devices may be used. For example, some embodiments of collision cells may include ringstacks or other devices to confine and transmit ions in the presence of a collision gas. The collision cell also may only be run in an RF only mode, which only uses an AC potential, which is typically designated with the lower case "q".

Control system 170 is provided to control overall operation of mass spectrometer device 100, including automatic tuning operations such as controlling focusing element 110, the energy of the collision cell 130, and controlling the operation of detector 140. For example, control system 170 automatically adjusts instrument control parameters, e.g. m/z settings, in one aspect. Control system 170 implements control logic that allows system 170 to receive user input and provide control signals to various system components. In certain aspects, control system 170 controls the sampling pattern of the compound ions 105.

In certain aspects, control system 170 includes a standalone computer system and/or an integrated intelligence module, such as a microprocessor, and associated interface circuitry for interfacing with the various systems and components of mass spectrometer device 100 as would be apparent to one skilled in the art. For example, control system 170 in one aspect includes interface circuitry for providing control signals to the different mass analyzers, and to the collision cell 130 for adjusting its energy. Control system 170 also typically includes circuitry for receiving data from the mass spectrometer system 100. The computer system (and/or the data-generation system) may include a computer readable medium, such as a hard disk drive or a device that reads a portable computer readable medium such as a CD or DVD reader, that is configured to store various computer code embodiments of the present invention. Control system 170 may be configured to run the computer code to execute various embodiment of the present invention. While control system 170 and mass spectrometer system 100 are shown as discrete systems, these systems may be an integrated system.

As mentioned above, in one embodiment, a QqTOF is used to implement embodiments of the present invention. In this embodiment, MS-2 of mass spectrometry system 100 is a TOF mass analyzer. For illustrative purposes, a QqTOF system will be used in the following discussion. However, it should be understood that aspects of the present invention also apply to other MS/MS spectrometry systems.

When used for MS-2, a TOF spectrometer differentiates among different fragment ions 108 based on the differences in time for the fragment ions to move from a starting point to detector 140. Ions with a higher mass arrive later than ions with a smaller mass. The ions are accelerated with a fixed electric field for a short period of time, thus creating a pulse of ions. For each pulse, the detector records a corresponding spectrum, called a transient. Typically, many transients are summed to create a mass spectrum.

Thus, during one analysis sub-cycle of a single QqTOF cycle, a specific compound (precursor) ion, such as type A, is chosen by MS-1. Compound ions A then move into the collision cell 130. In the collision cell, fragment ions are created from compound ions A. The fragment ions are then moved into the TOF analyzer at a steady rate to form a beam of fragment ions. A pulser applies an electric field at a set frequency, e.g. several kHz, which accelerates pulses of fragment ions that are each detected as a transient. Note that a reference of compound ion A corresponds to multiple ions of compound A.

As an illustration, assume that three compounds A, B, and C co-elude from a chromatograph during a single peak having a three second elution window. A single MS/MS analysis cycle that includes this elution window is used to analyze the compound ions A, B, and C. Thus, to perform an MS/MS analysis of A, B and C over the 3 second elution window, on average only one second is used to analyze each of the ions. The ions resulting from this elution window give an "ionic signal" that is analyzed by the mass analyzers. The remaining description will discuss the invention in terms of 3 precursors, however, it should be understood that the described embodiments and agents are applicable to analyzing 2, 3 or more compounds.

FIG. 2 illustrates a sampling pattern of an analysis cycle 200 covering a three second elution window with three co-eluting compounds (A, B, C). MS/MS cycle 200 is subdivided into three transient accumulation sub-cycles 201, 202, and 203; and 10,000 transients are collected per second. Each sub-cycle analyzes a different compound ion as is illustrated by column "Compound Ion." Typically, MS/MS cycle 200 is performed at a constant collision cell energy.

To improve coverage of the ionic signal, the above example is often changed using a different sampling pattern. FIG. 3 shows an MS/MS cycle 300 with an improved coverage of the ionic signal than MS/MS cycle 200. As each precursor ion is tested at more than one part of the ionic signal, the coverage is better. The number of transients for any particular sub-cycle typically has had a practical lower limit value. Currently available QqTOF systems are limited in how fast they can switch from one sub-cycle to another because the time spent switching the first mass analyzer from filtering one ion to another ion has been significant. Thus, the number of sub-cycles has been limited, and complex sampling patterns have not been explored, which has inhibited obtaining even better coverage of the ionic signal.

At times, additional information is required. For instance, using a range of collision cell energies during a sub-cycle may give more information. Varying the collision energy is particularly recommended when one analyzes unknown compounds for which one does not know the ideal collision energy. Varying the collision energies also provides a lower limit on the number of sub-cycles. Since the entire range of applicable collision cell energies is used during a single sub-cycle, a single sub-cycle must have a minimum number of transients in order to investigate every collision cell energy. Thus, as a species (compound ion) is fully investigated entirely before the next species are investigated, there are large contiguous time periods of the elution window that are not sampled for a particular compound ion. This poor coverage gives statistically inferior data.

For example, given the requirement of relatively long sub-cycles when multiple collision cell energies are investigated, the moment when a particular compound is present in the mass spectrum at high enough abundance could be missed. Thus, fully investigating a species before the next species is investigated can lead to the possibility that while species A was low and species B was high, A got sampled with varying collision energies until species B vanished. Such sampling patterns would cause a loss in sensitivity for carefully evaluating these particular compounds.

However with improved QqTOF systems that allow multi-channel rapid sampling, the chances to "catch" a compound when it is close to or at an apex value can be increased. For example, due to the increased sensitivity and increased speed of new Agilent QTOF systems, sophisticated sampling patterns can be handled over a narrow chromatographic peak (e.g., 2 to 3 seconds wide), which are, for instance, produced with Agilent's new HPLC-Chip cube. For example, switching the species rather than the collision energy offers much greater flexibility. In one embodiment, such complex sampling patterns are enabled by a very fast DSP-based sampling engine that allows not only to switch parameters, e.g., voltages for setting collision energy in the collision cell, during transient accumulation, but also to switch the compound ion to be investigated in MS/MS.

Figure 4:
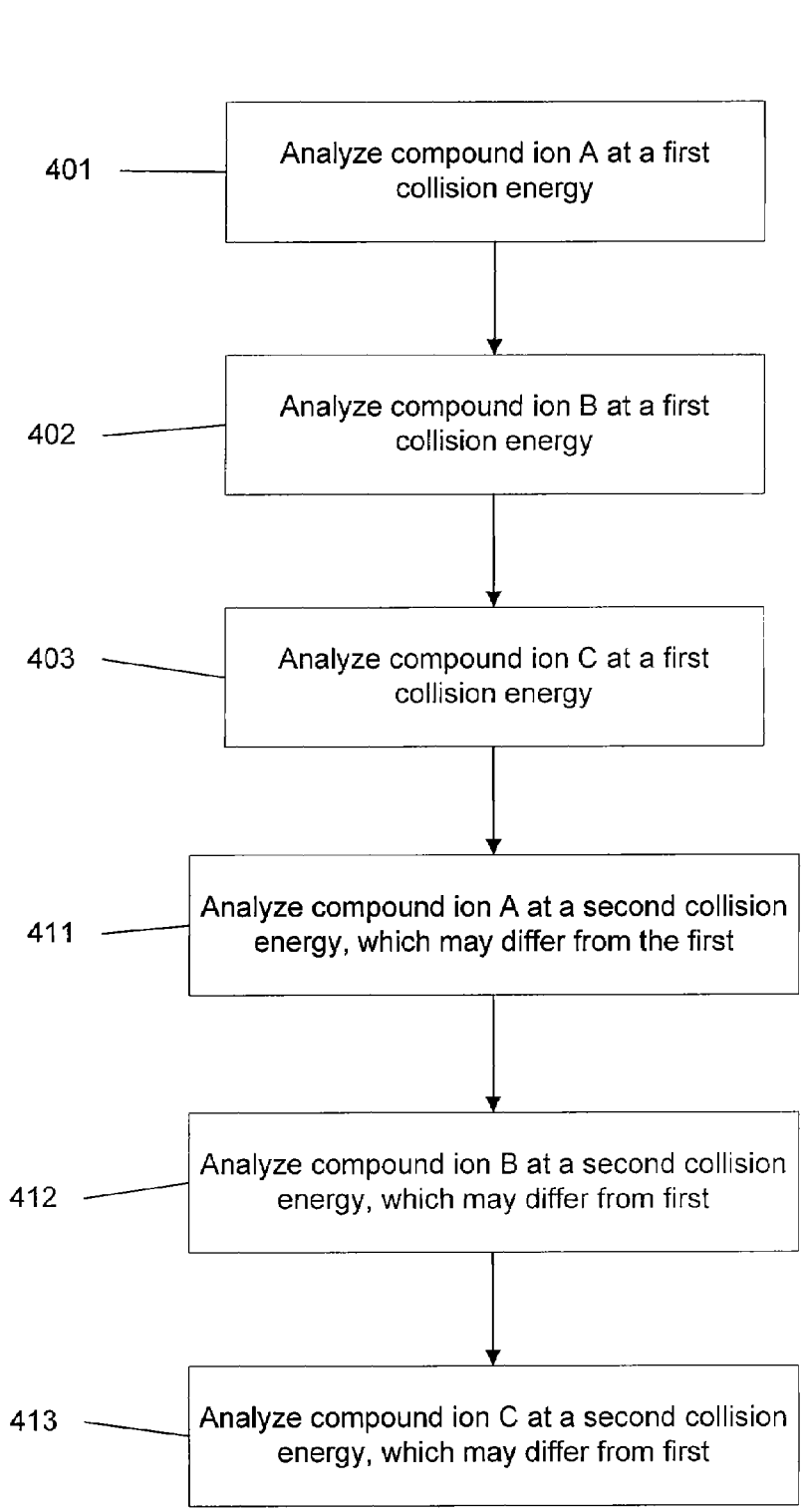
FIG. 4 illustrates a method for analyzing co-eluting compounds according to an embodiment of the present invention.

FIG. 4 illustrates an analysis method 400 incorporating a complex sampling pattern according to an embodiment of the present invention. In step 401, compound ion A is analyzed at a first collision energy. In step 402, compound ion B is analyzed at a first collision energy. In step 403, compound ion C is analyzed at a first collision energy. Each one of these steps is a different sub-cycle. Together these steps make up a set of sub-cycles.

FIG. 5 shows an exemplary MS/MS cycle 500 having a sampling pattern according to an embodiment of the present invention. Sub-cycle 501 corresponds to step 401; sub-cycle 502 corresponds to step 402; and sub-cycle 503 corresponds to step 403. Thus, sub-cycles 501-503 make up a first set of sub-cycles. In FIG. 5, the respective collision cell energies $CE_1(A)$, $CE_1(B)$, and $CE_1(C)$ are noted in the column marked "Fixed Collision Energy."

In a separate set of cycles, the compounds ions A, B, and C are analyzed a second time in a second set of sub-cycles. Returning to FIG. 4, in step 411, compound ion A is analyzed at a second collision energy, which may be different than the first one used in step 401. In step 412, compound ion B is analyzed at a second collision energy, which also may be different than the first one used in step 402. In step 413, compound ion C is analyzed at a first collision energy, which may be different than the first one used in step 403. In one aspect, at least one of the collision energies for a specific compound ion differs from the collision cell energy of the first set.

Returning to FIG. 5, sub-cycle 511 corresponds to step 411; sub-cycle 512 corresponds to step 412; and sub-cycle 513 corresponds to step 413. Thus, sub-cycles 511-513 make up the second set of sub-cycles. In this embodiment, each sub-cycle of the second set uses a different collision cell energy from the corresponding sub-cycle of the first set. For example, sub-cycle 511 uses $CE_2(A)$ while sub-cycle 501 uses $CE_1(A)$. In other embodiments, only one collision cell energy may differ between two sets. Also, the collision cell energies within a set of sub-cycles, e.g., $CE_1(A)$, $CE_1(B)$, and $CE_1(C)$, may all be different or some may be equal to each other.

FIG. 5 also illustrates eight other sets of sub-cycles, with the last (tenth) set being shown. Each corresponding sub-cycle of these sets uses a different collision cell energy. In this manner, each compound ion (A, B, and C) is analyzed at ten different collision cell energies. This complex sampling pattern allows for multiple collision cell energies while still providing maximal coverage of the ionic signal. For example, although one measurement of compound ion A at a particular energy may be made at a time when the abundance of A is low, other measurements at different energies will be made when A is higher. Thus, more accurate mass spectrums result from the analysis.

Compound ions analyzed in one set may not be analyzed in another set. For example, all of the compound ions may be analyzed in one set while only A and B are analyzed in a second set. Also, an additional compound ion may be measured only once in a cycle, such as for calibration purposes. Also, a set may have more than one sub-cycle that analyzes the same compound ion, as long as the full range of collision cell energies are not consecutively explored for that compound ion in that set.

FIG. 6 shows an MS/MS cycle 600 having a sampling pattern according to another embodiment of the present invention. In cycle 600, the number of transients differs between the sub-cycles of a set. For example, sub-cycle 601 analyzes 500 transients, and sub-cycle 602 analyzes 2,000 transients. This may be desirable when more accurate results of a particular compound ion may be desired. Also, if the relative concentration of a particular compound ion is low, then it may be desirable to spend more time (and collect more transients) on the compound ion that is in low abundance. For example, a single "transient" may last for about 100,000*1 nanosecond=100 microseconds. With 500 transients per spectrum, the time required for a full scan would be about 50 milliseconds and hence 20 full spectra per second can be accumulated. At 2000 transients per spectrum, 5 full spectra per second can be accumulated.

FIG. 7 shows an MS/MS cycle 700 having a sampling pattern according to another embodiment of the present invention. In cycle 700, the number of transients also differs between the sub-cycles of a set. In cycle 700, however, the number of transients for a sub-cycle analyzing A in one set is different than the number of transients for a sub-cycle of another set. For example, sub-cycle 701 of a first set analyzes 500 transients of compound ion A. Sub-cycle 711 of a second set analyzes 2,000 transients of compound ion A. This may be desired when an optimum sub-cycle number is not known. For instance, there may be an optimum transient number for a sub-cycle that gives the most accurate results. If the signal of an ion species is high, fewer transients are required to obtain a good signal-to-noise (S/N) ratio. In one embodiment, the total number of transients during a cycle is the same for each compound ion.

FIG. 8 shows an MS/MS cycle 800 having a sampling pattern according to another embodiment of the present invention. In cycle 800, only the collision cell energy used for precursor ion A differs from the first set to the second set. This is shown in the "Fixed Collision Energy" columns of sub-cycles 801 and 811 having the respective values $CE_1(A)$ and $CE_2(A)$. The sub-cycles 802 and 812 are shown as having the same collision cell energy $CE_1(B)$. In this embodiment, the collision cell energies for B and C are changed in subsequent sets. This is exemplified in the last set with cycle 892 having $CE_5(B)$ and cycle 893 having $CE_2(C)$. Thus, in this case, B was analyzed at five different collision cell energies and C was analyzed at two different collision cell energies. This may be desirable when the ideal collision energy for one compound ion is known to within a smaller range than another, and thus fewer collision cell energies need to be analyzed for that compound ion.

FIG. 9 shows an MS/MS cycle 900 having a sampling pattern according to another embodiment of the present invention. In cycle 900, the order that the compound ions are analyzed within a set of sub-cycles is varied. The resulting sampling pattern in cycle 900 is (A, B, C, C, A, B, C, A, B, C, C, A). This may be desirable when an abundance of a particular compound ion fluctuates with a particular frequency. Thus, if that compound ion is analyzed with the same frequency, it is possible that the analysis is consistently performed when the abundance is always at a low point. With an order that has some level of randomness in it, the regular frequency of fluctuations will not affect the accuracy of the results since a compound ion will not always be analyzed in the same part of the fluctuation.

In certain aspects, there is a benefit of only having to change the collision energy between two sub-cycles. For example, both sub-cycles 903 and 911 analyze precursor C. As these sub-cycles occur right after each other, then only the collision cell energy has to be changed to go from one sub-cycle to the other. This type of occurrence may even happen within the same set of sub-cycles, such as in the last set. In certain aspects, the sampling pattern can be highly complex and may need to be adjusted to the current situation. Factors that impact the choice of pattern include the signal strength of given ions at any given time and the knowledge of a reasonable range of collision energy.

One skilled in the art will recognize that there are other combinations of the number of transients collected for a sub-cycle, the order of the compound ions that are analyzed within a set of sub-cycles, the number of sub-cycles within a set and distribution of collision energies that are possible. In one aspect, the number of sub-cycles in a set of sub-cycles equals the number of precursor ions to be analyzed, e.g., the number of co-eluting precursor compounds.

Figure 10A:
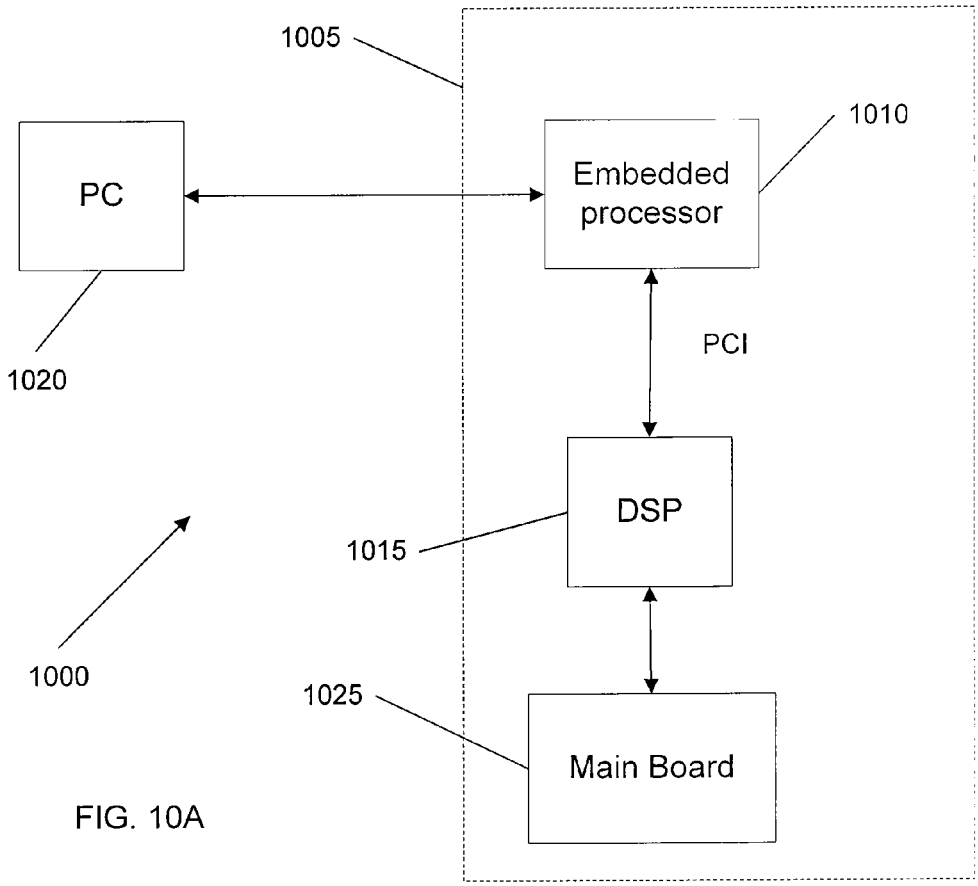
FIG. 10A illustrates a control system of a tandem mass spectrometer system according to an embodiment of the present invention.

FIG. 10A illustrates a control system 1000 that interfaces with a tandem mass spectrometer 1005 according to an embodiment of the present invention. Control system 1000 may correspond to the control system 170 of FIG. 1. In this embodiment, tandem mass spectrometer 1005 contains an "embedded" processor 1010, which may run under an operating system (OS) such as Linux or other OS. Processor 1010 communicates with a digital signal processor (DSP) 1015, both running custom firmware. In one aspect, this firmware controls all functions of the mass spectrometer hardware. A standard personal computer (PC) 1020 is used to input instructions, via a suitable interface such as a LAN, direct bus connection, wireless connection, etc, to mass spectrometer 1005, which may be done with specialized application software designed for that purpose.

To accomplish fast switching, a user sets up and starts an "Auto" or "Targeted" MS/MS cycle via the PC application. This information is sent to embedded processor 1010 via the interface which tells the firmware to start fast switching cycles. Fast MS/MS switching control of the mass spectrometer hardware is performed by DSP 1015, which is connected to embedded processor 1010 via a high speed interface, such as the peripheral component interconnect (PCI) interface. DSP 1015 controls the mass spectrometer by sending signals to a main board 1025. Main board 1025 may contain high voltage circuitry for the mass analyzers and the collision cell, as well as contain data acquisition circuitry for receiving data from a detector of the mass spectrometer. For example, in one aspect includes circuitry that creates voltages to steer and set the collision energy of the beam. It sends commands to power amplifier that drive the QTOF's quad mass analyzer (first mass filter in a QTOF). An "acquisition card" including detection element(s), or other detector devices, detects ions and creates spectra by summing "transients".

For each fast switching cycle, the firmware on embedded processor 1010 creates a complete package of parameters needed by DSP 1015 to perform the fast MS/MS switching cycle. This complete package of data includes all cycle parameters, such as those from cycles 500-900, and all hardware parameters which need to be changed at each sub-cycle. In one embodiment, the firmware provides all the cycle data at once to DSP 1015. Since DSP gets all the cycle data at once, the latency between each sub-cycle can be minimized. Processor 1010 can receive mass spectrum data from DSP 1015 at every measurement step, e.g., cycle, and provide the results to the PC application software via the interface. The final results are displayed on a monitor and/or stored to memory, e.g., in a file, without missing a cycle.

In a "Targeted" mode, the user inputs the specific sampling pattern to be used. In the "Auto" mode, a pre-scan is made by the mass spectrometer. In one aspect, in this pre-scan, the mass spectrometer only analyzes the compound ions from the chromatograph, but does not use the collision cell to create fragment ions. Thus, this is an MS mode. The mass spectrometer is used as a tandem mass spectrometer when fragment ions are analyzed by a second mass analyzer, termed an MS/MS mode. The information obtained from the pre-scan is used, e.g. by embedded processor 1010, to create the sampling pattern parameters needed by DSP 1015 to perform the fast MS/MS switching cycle. For example, a pre-scan in certain aspects tells the firmware what ions are present in the sample; based on this input, decisions are made to influence any further cycles. Also, control system 1000 is capable of displaying "real time" waveform data as the mass spectrometer 1005 is switched between MS mode and MS/MS mode when running in "Auto" mode.

In "Auto" mode, a determination could be made of the number of co-eluting precursor compounds that are of interest; an appropriate number of collision energies for each co-eluting precursor compound of interest; the number of sets, the number of sub-cycles for each set, the compound ion to be analyzed for each sub-cycle, the number of transients for each sub-cycle, and/or the collision cell energy for each sub-cycle.

Figure 10B:
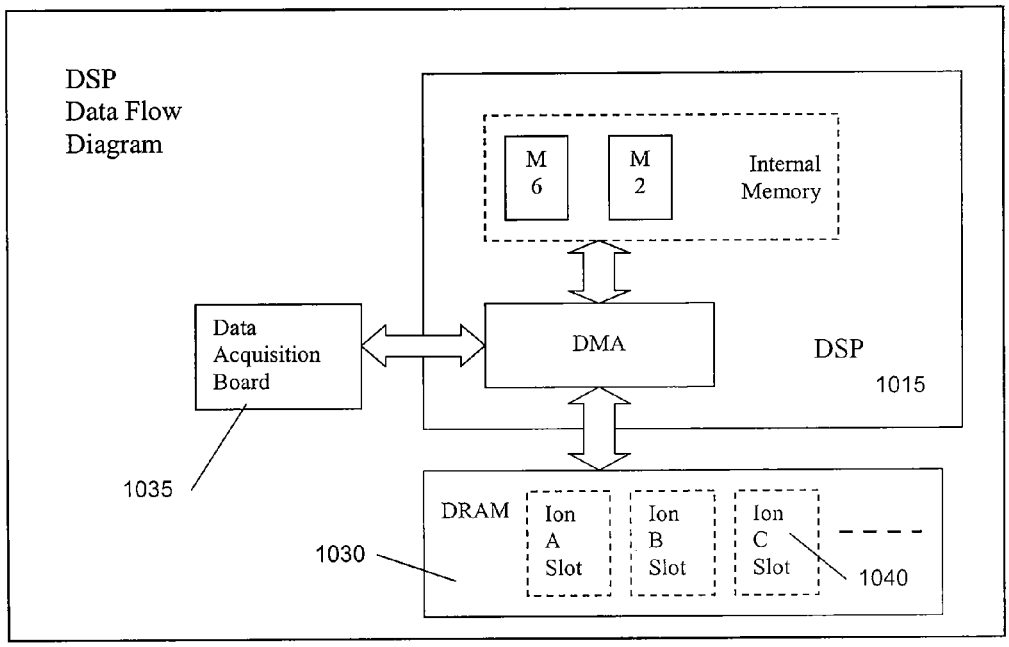
FIG. 10B illustrates a data flow diagram among logic in the control system of a tandem mass spectrometer system according to an embodiment of the present invention.

FIG. 10B illustrates the functionality of DSP 1015 according to an embodiment of the present invention. In one aspect, the system is architected to provide a dedicated amount of memory, e.g., a memory slot, such as slot 1040, for each ion investigated during one MS/MS cycle (one for A, one for B and one for C). After the MS/MS cycle, the data in all individual memory slots is sent to the host PC 1020 as individual spectra, or DSP 1015 can bunch them together using different algorithms. For example, in one aspect, bunching data from different memory slots together includes copying all memory slots together that belong to the same ion. In another aspect, data for a selected group of ions is bunched together. This is particularly advantageous when the investigated ions belong to the same compound. One important implementation of such an algorithm is to copy all memory slots together that belong to the same ion or group of ions. In certain aspects, data is separated into individual memory slots sorted by ion and applied collision energy. This is useful when only a few ions are analyzed and enough memory slots are available. The host SW can then more easily determine the best collision energy for each ion investigated. The internal memory is used for code and data storage as is well known.

Figure 11:
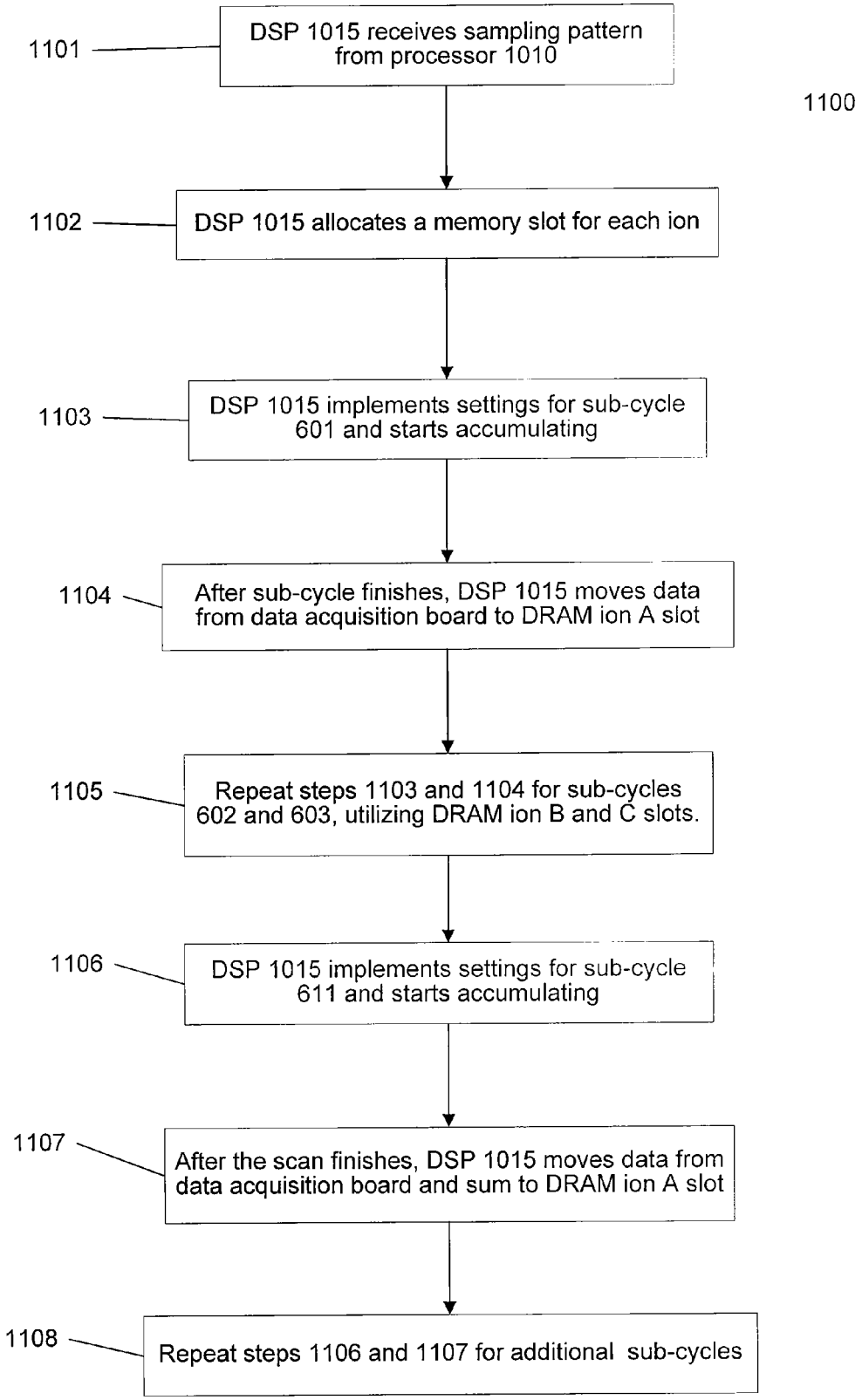
FIG. 11 illustrates a method of analyzing co-eluting compounds using a control system of a tandem mass spectrometer system according to an embodiment of the present invention.

FIG. 11 illustrates a process flow 1100 of DSP 1015 according to an embodiment of the present invention. As an illustration the steps corresponding to the first and second sets of cycle 600 of FIG. 6 are used.

In step 1101, the DSP receives a sampling pattern from the embedded processor. In step 1102, the DSP allocates a memory slot 1040 in DRAM 1030 for each compound ion to be analyzed. DRAM 1030 may be any suitable memory device that is readable and writeable, such as SDRAM or flash memory. In step 1103, DSP implements the settings for a sub-cycle, e.g., "500 transients for ion A using a given fixed collision energy $CE_1(A)$", and then starts the transient accumulation sub-cycle. In step 1104, after the scan for the sub-cycle finishes, DSP 1015 moves data from data acquisition board 1030 to DRAM ion A slot.

In step 1105, the implementation of the other sub-cycles, such as 602 and 603, and the movement of the resulting data into the DRAM ion B slot and the DRAM ion C slot are respectively done. Accordingly, these steps include implementing the settings for "2,000 transients for ion B using a given fixed collision energy $CE_1(B)$" and then starting a transient accumulation sub-cycle. After the scan finishes, DSP moves data from data acquisition board to DRAM ion B slot. DSP then implements "500 transients for C using a given fixed collision energy $CE_1(C)$" and then starts a transient accumulation sub-cycle. After that scan finishes, the DSP moves data from data acquisition board 1030 to DRAM ion C slot.

In step 1106, DSP implements "500 transients for A using a given fixed collision energy $CE_2(A)$" and starts a transient accumulation sub-cycle. In step 1107, after the scan finishes, DSP 1015 moves data from data acquisition board 1030 and sums this data with the data already in DRAM ion A slot. In step 1108, the implementation of the remaining sub-cycles is done and the resulting data is moved into and summed with the data already in the appropriate DRAM ion slot.

Code for implementing methods described herein, and other control logic, may be provided to control systems, such as systems 170 and 800, using any means of communicating such logic, e.g., via a computer network, via a keyboard, mouse, or other input device, on a portable medium such as a CD, DVD, or floppy disk, or on a hard-wired medium such as a RAM, ROM, ASIC or other similar device.

While the invention has been described by way of example and in terms of the specific embodiments, it is to be understood that the invention is not limited to the disclosed embodiments. To the contrary, it is intended to cover various modifications and similar arrangements as would be apparent to those skilled in the art. One skilled in the art will recognize the many ways that the aforementioned methods and systems may be combined to produce different embodiments of the present invention. Therefore, the scope of the appended claims should be accorded the broadest interpretation so as to encompass all such modifications and similar arrangements.

What is claimed is:

1. A method of analyzing two or more compound ions during an analysis cycle of a tandem mass spectrometer system, the method comprising:

analyzing the compound ions during a plurality of sets of analysis sub-cycles, wherein each of the compound ions is analyzed during each of said sets of sub-cycles, wherein the sub-cycles of a set occur consecutively in time, and wherein each sub-cycle uses a fixed collision cell energy, wherein:

a first compound ion is analyzed during a sub-cycle of a first set of sub-cycles using a first collision cell energy; and a second compound ion is analyzed during another sub-cycle of said first set of sub-cycles using said first collision cell energy; and the first compound ion is analyzed during a sub-cycle of a second set of sub-cycles using a second collision cell energy different than the first collision cell energy the second compound ion is analyzed during another sub-cycle of said second set of sub-cycles using said second collision cell energy.

2. The method of claim 1, wherein the compound ions that are analyzed in the sub-cycles of the first set of sub-cycles are analyzed in a different order in a subsequent set of sub-cycles.

3. The method of claim 1, wherein the number of compound ions equals the number of co-eluting precursor compounds, and wherein the number of sub-cycles in a set of sub-cycles equals the number of compound ions.

4. The method of claim 1, wherein the collision cell energy of at least one sub-cycle within a first set of sub-cycles is different from the other collision cell energies of the other sub-cycles of the first set.

5. The method of claim 1, wherein a duration of one sub-cycle is different than the duration of another sub-cycle.

6. The method of claim 1, further comprising:

previous to the analyzing, determining a number of co-eluting precursor compounds that are of interest;

determining an appropriate number of collision energies for each co-eluting precursor compound of interest; and setting the number of transients and collision energy of each sub-cycle.

7. The method of claim 1, wherein the fixed collision cell energy of at least one sub-cycle that analyzes the first compound ion is different from the fixed collision cell energies of the other sub-cycles that analyze the first compound ion.

8. The method of claim 7, wherein the fixed collision cell energy of at least one sub-cycle is different from the fixed collision cell energies of the other sub-cycles that analyze the same compound ion.

9. The method of claim 7, wherein the collision cell energies of the sub-cycles that analyze the first compound ion successively increase or decrease for each set.

10. The method of claim 1, wherein the tandem mass spectrometer system comprises a quadrupole time-of-flight spectrometer.

11. The method of claim 10, wherein a duration of each sub-cycle is determined by a specified number of transients.

12. The method of claim 11, wherein the number of transients for each sub-cycle is the same.

13. The method of claim 11, wherein the number of transients for the sub-cycles of a set of sub-cycles vary.

14. The method of claim 13, wherein the total number of transients analyzed during a cycle may be the same for each compound ion.

15. An information storage medium that stores a plurality of instructions adapted to direct an information processing device to provide control signals to a tandem mass spectrometer to perform an operation of analyzing two or more compound ions during an analysis cycle of the tandem mass spectrometer system, the operation comprising the steps of:

analyzing the compound ions during a plurality of sets of analysis sub-cycles, wherein each of the compound ions is analyzed during each of said sets of sub-cycles, wherein the sub-cycles of a set occur consecutively in time, and wherein each sub-cycle uses a fixed collision cell energy, wherein:

a first compound ion is analyzed during a sub-cycle of a first set using a first collision cell energy; and a second compound ion is analyzed during another sub-cycle of said first set of sub-cycles using said first collision cell energy; and the first compound ion is analyzed during a sub-cycle of a second set analyzes using a second collision cell energy different than the first collision cell energy the second compound ion is analyzed during another sub-cycle of said second set of sub-cycles using said second collision cell energy.

16. The information storage medium of claim 15, wherein the compound ions that are analyzed in the sub-cycles of the first set are analyzed in a different order in the sub-cycles of the subsequent set.

17. The information storage medium of claim 15, wherein the collision cell energy of at least one sub-cycle within a first set of sub-cycles is different from the other collision cell energies of the other sub-cycles of the first set.

18. The information storage medium of claim 15, wherein a duration of one sub-cycle is different than the duration of another sub-cycle.

19. The information storage medium of claim 15, further comprising:

previous to the analyzing, determining a number of co-eluting precursor compounds that are of interest;

determining an appropriate number of collision energies for each co-eluting precursor compound of interest; and setting the number of transients and collision energy of each sub-cycle.

20. The information storage medium of claim 15, wherein the fixed collision cell energy of at least one sub-cycle that analyzes the first compound ion is different from the fixed collision cell energies of the other sub-cycles that analyze the first compound ion.

21. A tandem mass spectrometer system for analyzing two or more compound ions during an analysis cycle, the system comprising:

a tandem mass spectrometer including a first mass analyzer, a collision cell, and a second mass analyzer; and a control system including:

a processor for determining parameters for a cycle of the tandem mass spectrometer, wherein the parameters include a number of sets of analysis sub-cycles, a number of sub-cycles for each set, a compound ion to be analyzed for each sub-cycle, a number of transients for each sub-cycle, and the collision cell energy for each sub-cycle; and a controller for providing control signals to the tandem mass spectrometer based on the parameters, wherein the signals control the analysis of the compound ions, wherein the control signals control the mass spectrometer to analyze each of the compound ions during each of said sets of sub-cycles, wherein the sub-cycles of a set occur consecutively in time, and each sub-cycle uses a fixed collision cell energy, and wherein:

a first compound ion is analyzed during a sub-cycle of a first set using a first collision cell energy; and a second compound ion is analyzed during another sub-cycle of said first set of sub-cycles using said first collision cell energy; and the first compound ion is analyzed during a sub-cycle of a second set using a second collision cell energy different than the first collision cell energy the second compound ion is analyzed during another sub-cycle of said second set of sub-cycles using said second collision cell energy.

22. The tandem mass spectrometer system of claim 21, wherein the processor and controller are integrated within the mass spectrometer.

23. The tandem mass spectrometer system of claim 21, wherein the controller includes a digital signal processor.

24. The tandem mass spectrometer system of claim 21, wherein the processor executes an operating system.

25. The tandem mass spectrometer system of claim 21, wherein the processor and controller are part of the same integrated circuit.

26. The tandem mass spectrometer system of claim 21, wherein all of the parameters for a cycle are sent from the processor to the controller before the analysis of the cycle begins.

27. The tandem mass spectrometer system of claim 21, wherein the control system further includes a memory device having a memory slot for each compound ion that is analyzed during a cycle, wherein a slot holds mass spectrum data for a particular compound ion.

28. The tandem mass spectrometer system of claim 27, wherein the control system further includes a data acquisition circuit, wherein the controller transfers data after each sub-cycle from the data acquisition circuit to the memory slot allocated for the compound ion analyzed during that sub-cycle.

29. The tandem mass spectrometer system of claim 21, wherein the second mass analyzer is a time-of-flight analyzer.

30. The tandem mass spectrometer system of claim 29, wherein the first mass analyzer is capable of being switched from analyzing one compound ion to another compound ion within about 10 milliseconds or less.

31. The method of claim 1, wherein the two or more compound ions result from co eluting precursor compounds.

32. The system of claim 27, wherein ions are bunched into memory slots based on one of the ion type, the collision energy used and whether the ions are related.

* * * * *